United States Patent [19]

Sakaki

[11] 4,383,881

[45] May 17, 1983

[54] STRAPPING MACHINE

[75] Inventor: Yasunori Sakaki, Tokyo, Japan

[73] Assignee: StraPack Shimojima Co., Ltd., Tokyo, Japan

[21] Appl. No.: 303,042

[22] Filed: Sep. 17, 1981

[51] Int. Cl.[3] ..... B65S 13/32

[52] U.S. Cl. ..... 156/361; 100/33 PB; 156/494

[58] Field of Search ..... 156/494, 350, 361; 100/33 PB, 33 R, 4, 29, 30, 32

[56] References Cited

U.S. PATENT DOCUMENTS 3,442,203 5/1969 Kobiella ..... 100/33 PB 3,759,169 9/1973 Goodley ..... 100/33 PB X

*Primary Examiner*—David A. Simmons

*Attorney, Agent, or Firm*—Burns, Doane, Swecker & Mathis

[57] ABSTRACT

A strapping machine feeds a band around an object to be strapped. A drive roller then retracts the band so that the latter may be fused and severed. A drive shaft drives the drive roller. When the band has been fully retracted, the drive roller and drive shaft cease rotation. A fly wheel is operably connected to the drive shaft and continues to rotate after rotation of the drive shaft ceases. The axis of the fly wheel travels in response to the continued rotation of the fly wheel. A support is operably connected to the fly wheel and travels therewith to actuate a shut-off switch.

11 Claims, 17 Drawing Figures

STRAPPING MACHINE

FIELD OF THE INVENTION

This invention relates to a strapping machine which straps packages by means of a thermally fusable plastic band, and especially to means for detecting the completion of a process in which the thermally fusable plastic band after being fed to a package is retracted to tighten the package.

DESCRIPTION OF PRIOR ART

The present invention is an improvement over U.S. Pat. No. 3,759,169, issued Sept. 18, 1973, and more particularly over the detecting mechanism for detecting completion of the band tightening in the strapping machine disclosed in FIGS. 3 and 24 of said U.S. patent. The detecting mechanism of the U.S. patent detects a completion of tightening by an impact received by a feed roller when a band has been tightened to a package. The details of the improvement will be clarified by the detailed explanations of the invention, which are referred to later.

SUMMARY OF THE INVENTION

This invention relates to means for detecting the completion of retracting and tightening of a band in a strapping machine. When the retracting or the tightening of said band reaches a predetermined value, that is if a certain torque is applied to the feed roller which retracts the band, the fly-wheel moves due to said torque and the completion of said retracting or tightening is detected owing to the movement of said fly-wheel whereby a predetermined signal is generated.

BRIEF DESCRIPTION OF THE DRAWINGS

The drawings show embodiments of the present invention.

FIG. 11 is a partially sectional view of a feeding and tightening apparatus of band;

FIG. 12 is a side view showing detecting means for tightening completion of band;

FIG. 13 is a side view of the feed roller portion which feeds and tighten the band;

FIG. 14 is a plan view of FIG. 13; and

FIG. 15 is a partially, longitudinally sectional view of FIG. 13.

DESCRIPTION OF THE PREFERRED EMBODIMENTS

Embodiments according to the present invention are mentioned below in detail in conjunction with the accompanying drawings.

Figure 1:
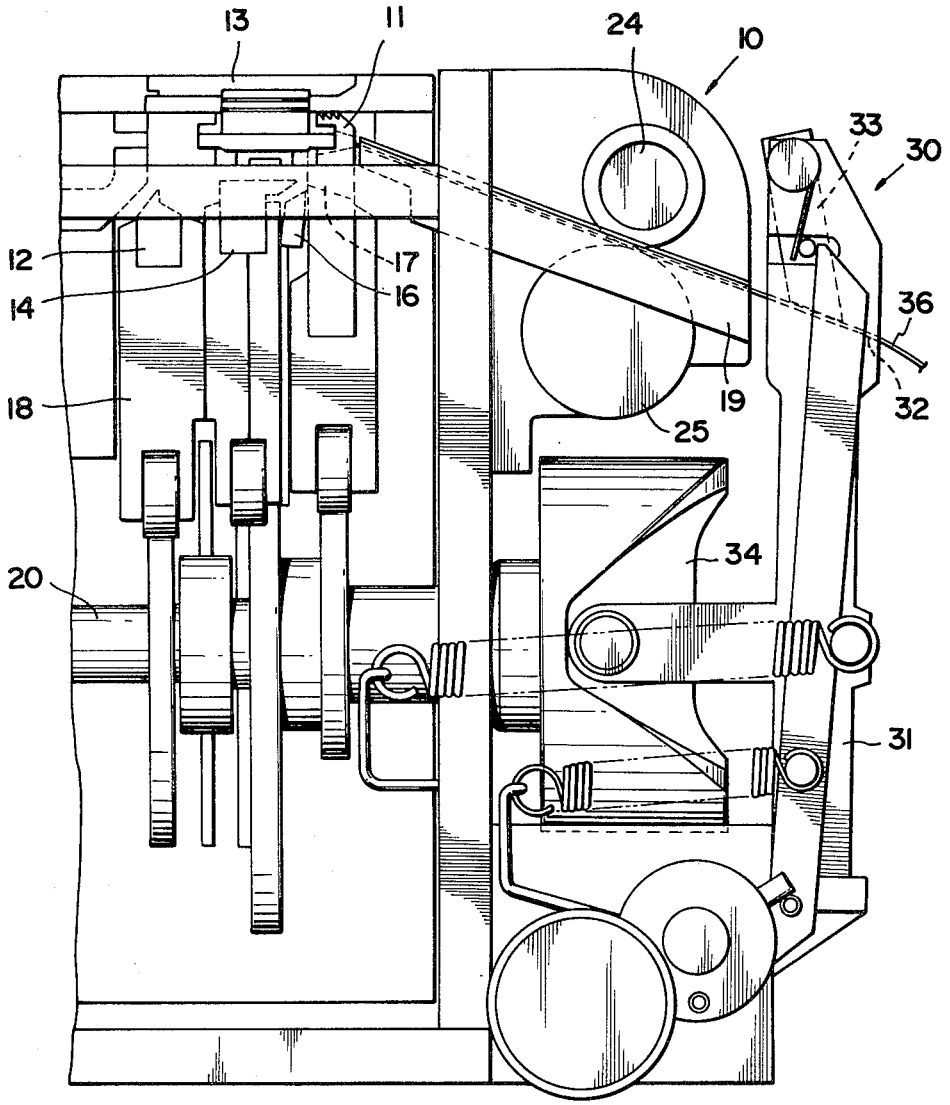
FIG. 1 is a partial side view showing parts of the strapping machine.
Figure 2:
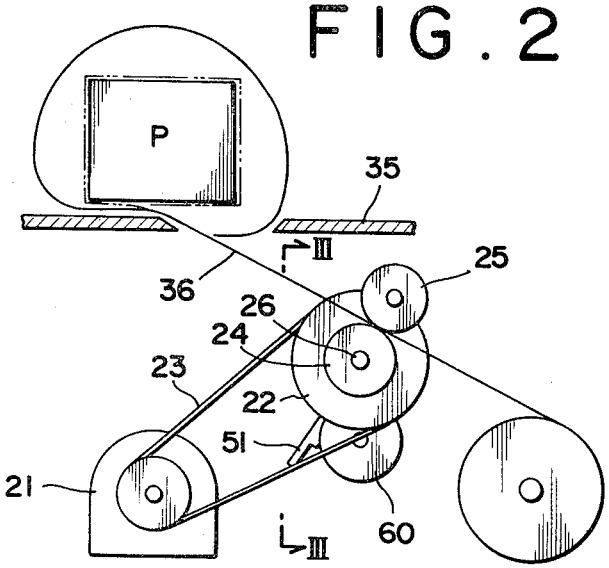
FIG. 2 is a side view showing the outline of the total machine.

FIGS. 1 and 2 are schematic views showing an example of band feeding and retracting mechanisms according to this invention. References (24), (25) constitute a pair of feed rollers a feeder (10), these rollers rotate in contact with a thermoplastic band (36) and feed said band (36) out of the strapping machine body (35). Reference (11) is a right-hand press and constitutes a gripping device which fixes the end of a band at a space formed together with a slide table (13), while reference (12) is a left-hand press and constitutes a gripping device which fixes the fed end of the band at a space formed together with said slide table (13). After the band is retracted by said pair of feed rollers (24,25) and tightened to a package by a tightening device (30) referred to later, the tightened state is maintained. Numeral (14) is a center press, the press pressure fuses the band through a heater (not shown), which advances into the overlapping portion of the band, and it adheres under pressure the overlapping faces of the band after the withdrawal of the heater. Numeral (16) is a cutter which is provided on said center press (14) and it severs the fed end of the band at the lower end of a through hole (17) of the band in the right-hand press (11) as it rises with said center press. Said left-hand press (12), center press (11) and right-hand press (11) are embedded respectively in blocks (18), while they vertically move through the rotation of a cam shaft (20). Reference numeral (30) is a band-tightening mechanism which holds the band feeding (upstream) side between a channel (32) provided at the upper portion of a tension arm (31) and a jaw (33) rotatable in said channel. Rotation of said tension arm to the right through the rotation of a tension cam (34) tightens the band by a certain stroke, and the tension arm (31) is rotated to return toward a band chute (19) by said tension cam (34) which continues to turn after the fusing and severing processes of the band. That is, the band is retracted (a primary tightening) by said pair of feed rollers (24), (25) and the band thus retracted is further tightened by said tension arm (31) when a package is tightly fastened (a secondary tightening) by the band.

Figure 3:
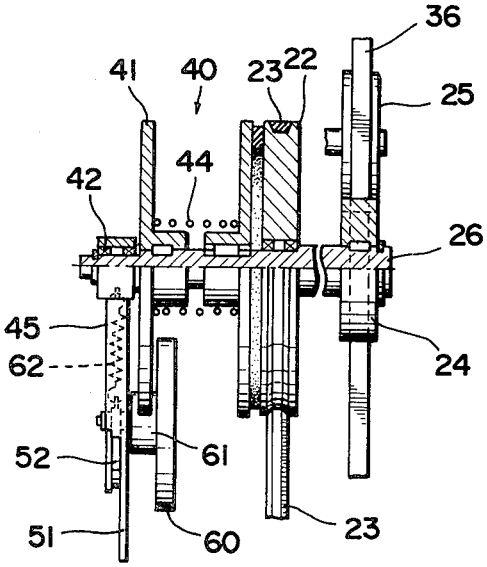
FIG. 3 is a partially sectional view taken along the line III—III of FIG. 2.
Figure 4A:
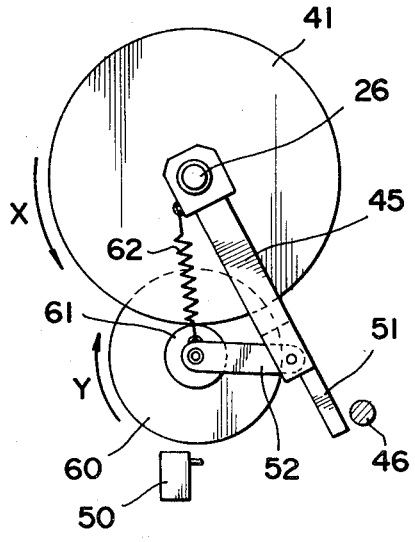
FIG. 4 is a schematic view illustrating the operating state in the first embodiment.
Figure 4B:
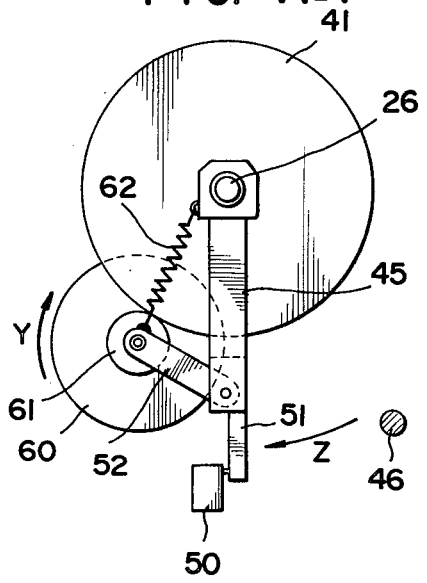
Figure 5:
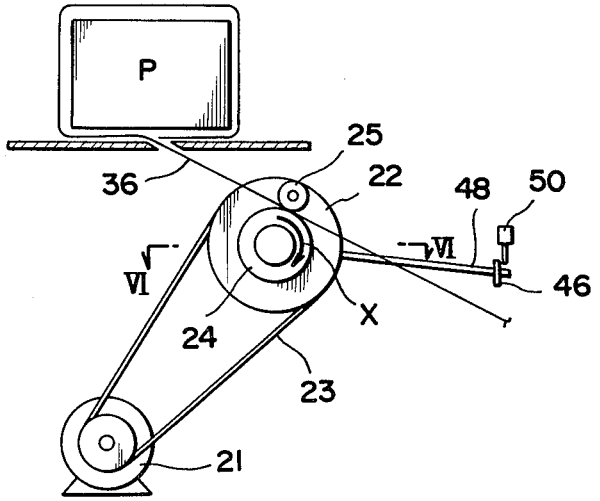
FIG. 5 is a total, schematic view illustrating the second embodiment.

FIG. 2 is a partially sectional view showing a first embodiment of the means of the invention. That is, the rotation of a pulley connected to motor (21) through a suitable reduction mechanism is transmitted to a drive roller (24) by a belt (23) whereby the band (36) wound around the package on the strapping machine body is retracted while being gripped with an inverting roller. In the present invention, as shown in FIG. 3, the rotation by said motor (21) is transmitted, by the belt 23, to a pulley (22) idly mounted on a drive shaft (26) of the drive roller (24). The pulley (22) is brought into sliding contact with a clutch mechanism such as a friction clutch (40) on the same shaft (26), and said clutch (40) is pressed toward the pulley (22) by a coil spring (44) whose one end is anchored at one side wall of a rotational member (41) which is likewise firmly secured to the shaft (26). Further, a support member (45) is swingably provided, through a bearing (42) and the like, at a position adjacent to said rotational member (41) of the shaft (26). At the lower end of said support member (45) there is formed an operating rod (51) into the path of travel of which is projectingly inserted an end roller of a limit switch 50 for controlling the tightening drive, and one end of a bearing member (52) is rotatably mounted on said support member (45). At the other end of the bearing member (52) there is turnably provided, as shown in FIGS. 4(A), 4(B), a driven roller (61) having a flywheel (60) and made of a material such as rubber. Said bearing member (52) is connected to said swinging arm (45) through a spring (62) so as to energize the driven roller (61) in such a way that the roller is always brought into sliding contact with the peripheral flange of the rotational member (41) on the drive shaft (26). Additionally, reference (46) is a stopper. Furthermore, in the above embodiment, in the outer circumferences of the rotational member (41) and the driven roller (61) there may be engravingly provided a gear by which said member and roller mesh with each other.

Referring to the function of the first embodiment, when the end of the band is fixed and the rotation of the pulley (22) is transmitted to the shaft (26) by means of the sliding contact of the clutch (40) as shown in FIG. 4(A) thereby turning the drive roller (24) and retracting the band, the rotational member (41) secured to the shaft (26) also turns in the same direction as the drive roller (24). In case the drive roller (24) rotates in the direction of the arrow X of FIG. 4(A), the support member (45) is displaced aside to the right as in the same Figure thanks to the frictional force between said driven roller (61) rotating in the direction of the arrow Y and said rotational member (41) until said support member is stopped by the stopper (46), so that the operating rod (51) never happens to engage with the limit switch (50). Next, after the band is retracted and wound around a package, the drive roller (24) and the reaction roller (25), are prevented from rotation thanks to the friction with the band. However, the driven roller (61) turning with the fly-wheel (60) moves along the peripheral flange of the rotational member (41), while rotating continuously in the direction of the arrow Y due to inertia. Accordingly, the swingable arm (45) connected to said driven roller (61) is moved in the direction of the arrow Z of FIG. 4(B), and the operating rod (51) at the end of said support member (45) engages with said limit switch (50). Thus, a signal for the completion of band retraction (the primary tightening) generates, where upon (i) the clutch of the reduction gear which turns said cam shaft (20) becomes ON, (ii) the reverse rotation of said rollers (24,25) ceases, (iii) the tension cam (34) starts to rotate to impose a band fastening (the secondary tightening) of the article to be strapped by the tension arm (31), and (iv) after the revolution of the tension arm by a certain stroke the left-hand press (12) rises to maintain the tightening state of the band to the article. Further, (v) a heater is inserted into the overlapping portion of the band, (vi) the end of the fed band is severed by the center press (14), (vii) the overlapping portion of the band is pressure fused, and (viii) after the withdrawal of the heater the fused, overlapping portion of the band is adhered under pressure, while the slide table (13) moves back thereby finishing one strapping cycle.

The embodiment as described above is constructed in such manner that a support member (45) is arranged on the same shaft (26) a drive roller (24) and a rotational member (41) which slidably contacts a driven roller (61) is a clutch wheel of a clutch (40), but they can be arranged in any position.

A second embodiment will then be described in detail with reference to FIGS. 5 to 9.

The rotation of the motor (21) is transmitted by a belt (23) to the pulley (22) which is mounted by a bearing (27) on the drive shaft (26) of the feed roller (drive roller) (24). Said pulley (22) is brought into sliding contact with the clutch mechanism of for example friction clutch (40), and a clutch plate (43) which slidably contacts one side of the pulley (22) is pressed towards the pulley by a coil spring (44) whose one end is anchored to an anchoring plate fixed to the drive shaft (26). Further, a support member (47) is mounted through a bearing (28) on the drive shaft (26). In a suitable position of the peripheral wall of said support member (47) there is firmly fixed an operating rod (48), and the end of said rod is loosely inserted into a stopper (46) mounted to the strapping machine body whereby the end of a limit switch (50) is brought within the swinging range of the end of said operating rod.

Figure 6:
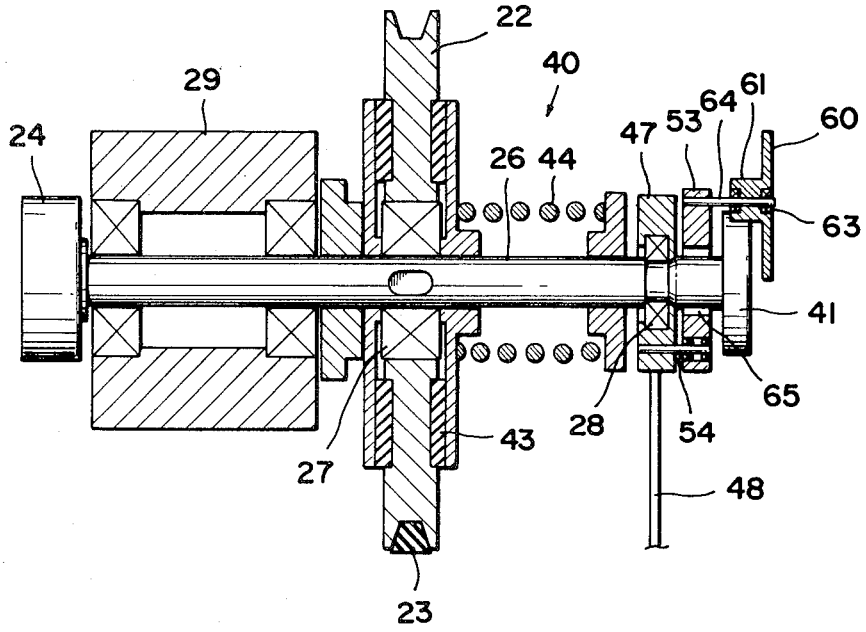
FIG. 6 is a sectional view taken along the line VI—VI of FIG. 5.
Figure 7:
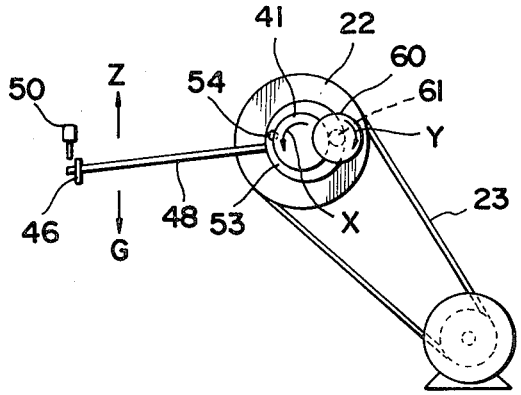
FIG. 7 is a schematic side view taken from the back side of FIG. 5.
Figure 8:
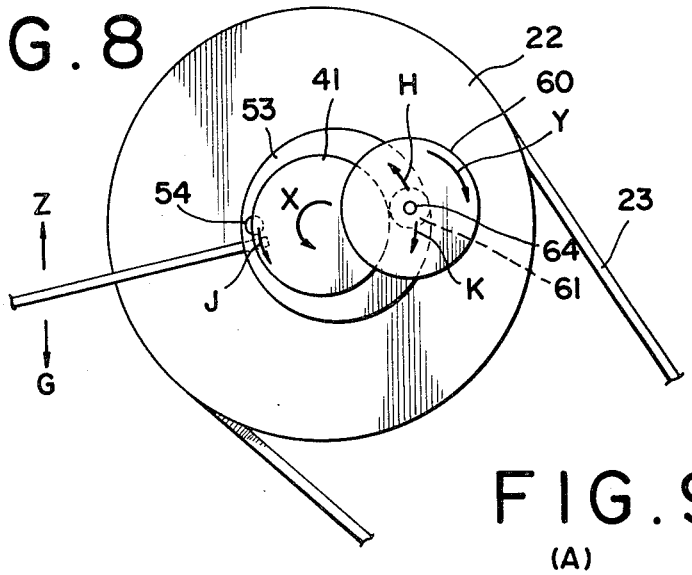
FIG. 8 is a schematic view illustrating an operating state of the machine.
Figure 9:
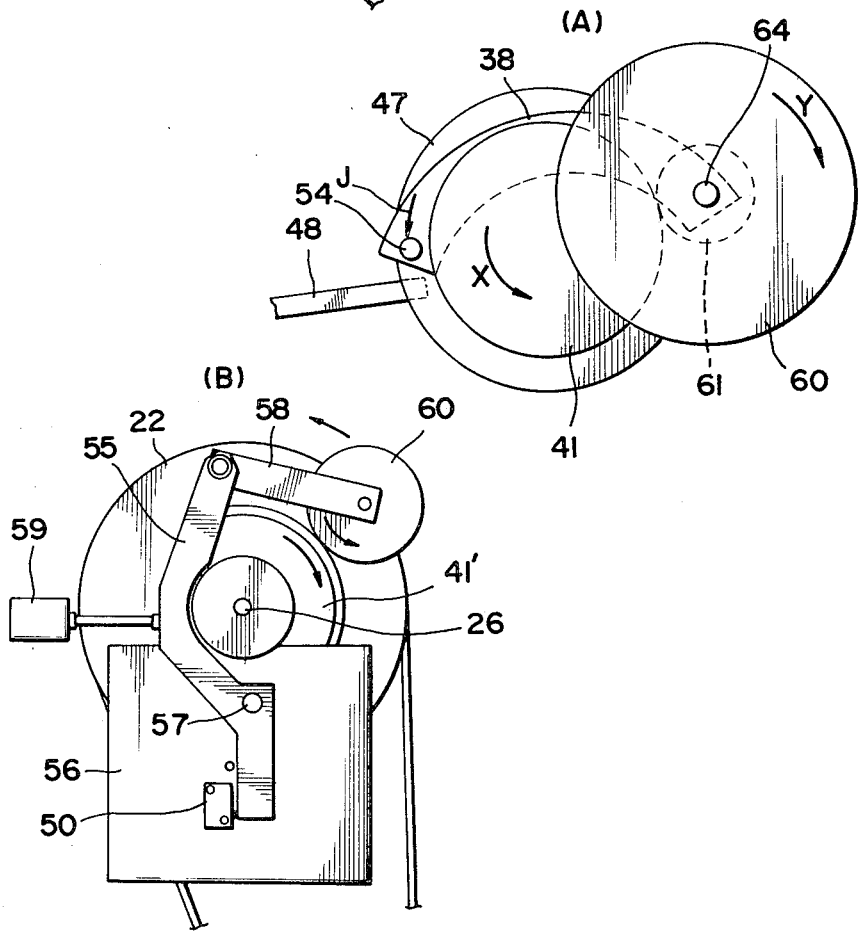
FIG. 9(A) and 9(B) are schematic views illustrating other embodiments respectively.

Reference (29) designates a bearing casing. In addition, adjacent to said support member (47) a bearing member (53) is idly fitted onto the drive shaft (26). Said bearing member consists of an annular member having a diameter of inscribed circle, which is larger than that of the drive shaft (26), to be eccentric from the center of the shaft. The side walls of the bearing member (53) and the support member (47) are connected through a connecting shaft (54) as shown in FIG. 6. In approximately a diametrically opposite position to the connection position of said connecting shaft (54) there is firmly fixed a shaft rod (64) which rotatably supports, through a bearing (63), a driven roller (61) having a fly-wheel (60). Moreover, the rotational member (41) is engage slidably with said driven roller (61), said member (41) being formed integrally with or separately from said shaft (26), at the end portion of the drive shaft (26) and in a neighboring position of said bearing member (47).

Reference (65) is a space which is created between the bearing member (53) and the shaft (26).

Functions of this second embodiment will now be described.

In FIG. 6, when the rotation of the pulley (22) is transmitted to the drive shaft (26) owing to the sliding contact of the clutch (40), allowing the feed roller i.e. the drive roller (24), and the reaction roller (25) to rotate and tighten the band, the rotational member (41) rotates in the same direction as the drive roller (24). While the drive shaft (26) is turning in the direction of the arrow X in FIG. 8 together with the drive roller (24) and the rotational member (41), the driven roller (61) and the fly-wheel (60) rotate in the direction of the arrow Y. The roller and fly-wheel are brought into slidable contact with the rotational member (41) and due to the rotational force of the driven roller and the fly-wheel, said shaft rod (64) is moved in the direction of the arrow H. Accordingly, the bearing member (53) to which one end of said shaft rod (64) is secured is moved also in the direction of the arrow H.

On the other hand, the connecting shaft (54) is lowered in the opposite direction to said shaft rod (64) i.e. in the direction of the arrow J, said shaft (54) being positioned approximately opposite diametrally to the fixing position of said shaft rod (64) and connecting the support member (47) with the bearing member (53). Therefore, the operating rod (48) firmly secured to the support member (47) is moved i.e. descend in the direction of the arrow G until it engages the stopper (46), and the end of said operating rod (48) never operates the limit switch (50).

Then, when the band is fully wound around the article P to be strapped, the drive roller (24) and the reaction roller (25) stop owing to the friction with the band, and the clutch (40) slides so as not to transmit the rotation of the pulley (22) to the drive shaft (26) so that the shaft (26) and therefore with the rotational member (41) stops. At this time, the driven roller (61) being rotated with the fly-wheel (60) moves along the peripheral flange of the rotational member (41), namely descends in the direction of the arrow K, under the influence of the inertia of the fly-wheel (60) as it rotates in the direction of the arrow Y. The shaft rod (64) axially supporting the driven roller (61) moves also in the direction of the arrow K. At the same time the bearing member (53) connected to said shaft rod (64) is lowered when coupled with the weight of the fly-wheel (60). The driven roller (61) is immediately brought into contact in the direction of the axial center line of the rotational member (41), thereby moving i.e. raising in the direction of the arrow Z, the operating rod (48). When the tip of the operating rod (48) is pressed against the end of the limit switch (50) the rotation of the motor stops.

FIG. 9(A) shows still another form of the second embodiment, wherein the driven roller (61) and the swinging wheel (47) are connected by a crank (38) in the form of an arc for example which is not in contact with the shaft when operating. Additionally, it is possible to make the peripheral flanges of both the driven roller (61) and the rotational member (41) gears and to make them mesh with each other, ensuring the coupled movement of the two members. Description has been made above with regard to the embodiment wherein the drive shaft of the drive roller among feed rollers is provided with the means of the present invention. However, since the drive roller and the reaction roller synchronously revolve in their opposite directions by the gears arranged in their respective shafts thereby to feed and retract the band while gripping it, it can be optionally selected in practical operation to suitably modify the mounting position and the shape of each of the members, such that the machine can be operated by placing the subject to any shaft of the drive roller and the reaction roller.

FIG. 9(B) shows another form of the second embodiment where the lower end of a support member (55) consisting of a <-shaped crank is supported by bearing (57) to an adapter plate (56). The upper end is mounted to a rotatable bearing member (58) having a fly-wheel (60), and the fly-wheel abuts the peripheral flange of a clutch plate (41'). The lower end of a support member (55) is extended downward from the supporting point (57) of the member to press a limit switch (50) mounted on the adapter plate (56). At the center of said support member (55) a weight (59) is provided acting in the opposite direction to the fly-wheel (60) to maintain a weight balance with the fly-wheel. When the band tightening torque reaches a certain value the rollers stop, and therefore a drive shaft (26) also stops so that the clutch plate (41') slides, i.e., does not transmit the rotation of the pulley (22) to the shaft (26). At that time, the clutch wheel (60) rotating anticlockwise on the circumferential flange of the clutch plate (41') due to its inertia, travels to the left as in FIG. 9(B) along said circumferential flange of the clutch plate. Accordingly, the lower end of the support member (55) being connected to the bearing member (58) supporting by bearing the fly-wheel (60) moves to the right. In the present embodiment, movement of the member (55) away from the limit switch (50) sets the limit switch on, whereupon the rollers are stopped from reversion, and the fed band end in the cam shaft is gripped thereby finishing one cycle of severing and fusing of the band.

A third embodiment of the invention will now be described.

In this embodiment both the retracting and tightening of the band are carried out by a pair of rollers, and unlike in the above embodiments the band is not tightened by a tension arm so that the embodiment presents detecting means in a strapping machine in which infinitely great tightening width can be obtained.

Figure 10:
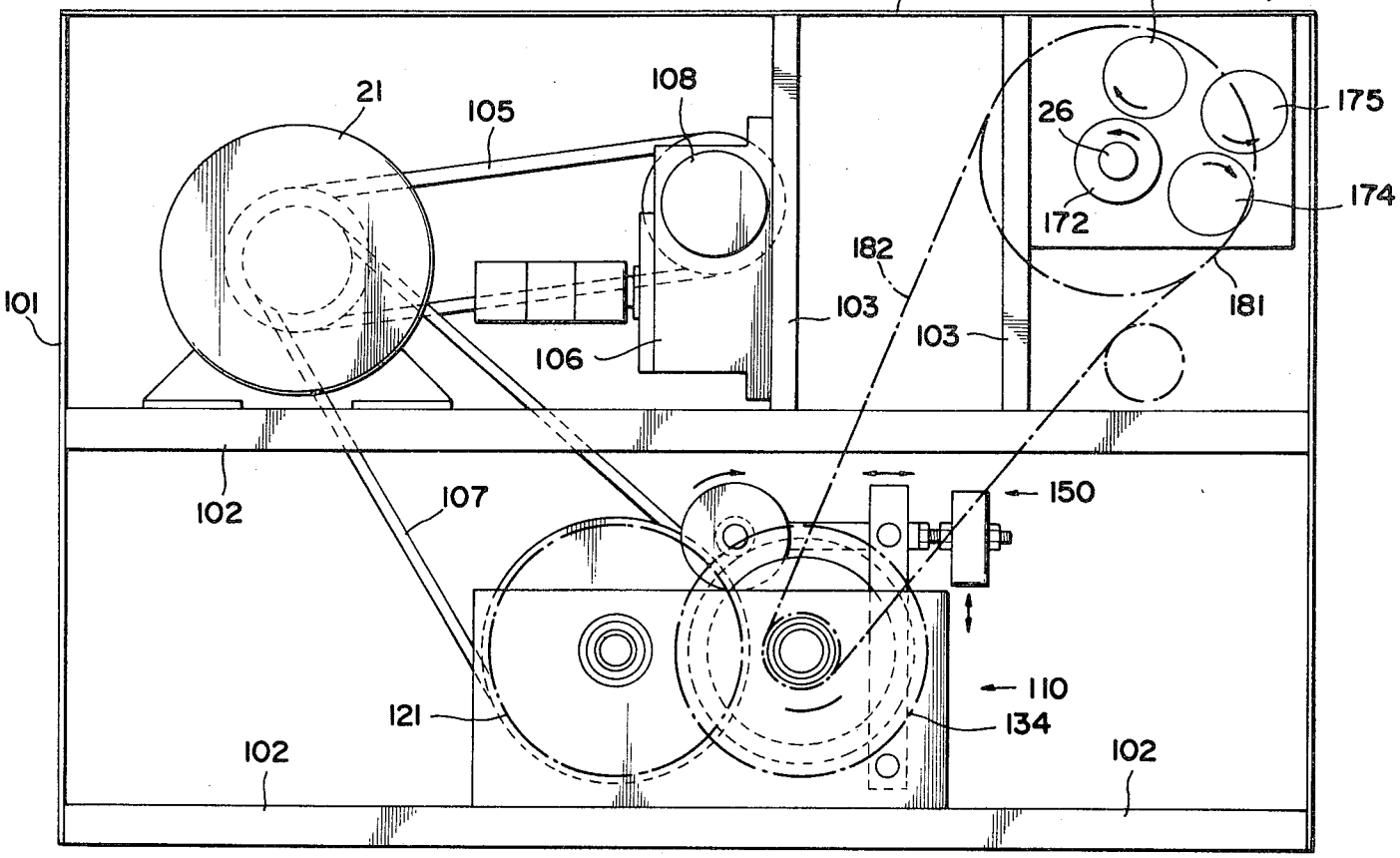
FIGS. 10 to 15 show a third embodiment, while FIG. 10 being an explanatory view of the whole machine.

In FIG. 10, reference (101) is an external plate which forms the main body of the strapping machine, reference (102) is a machine bed and reference (103) is a machine frame. A motor (21) is disposed on the bed (102). A reduction gear (106) which is connected through a belt (105) with said motor is set on the machine frame (103), and to said motor (21) is likewise connected through a belt (107) a pulley (121) provided at the end of the input shaft of a band feeding, retracting and tightening mechanism (110) on the machine bed (102). A sprocket is keyed to the end of the input shaft of said mechanism (110), and through a chain (182) it is connected to a sprocket (181) at the end of the drive shaft (26) in a feed roller portion (170). Further, a clutch (108) is arranged on the input shaft of the reduction gear (106), and reference (150) shows an embodiment of the detecting means which detects a finished tightening.

Figure 11:
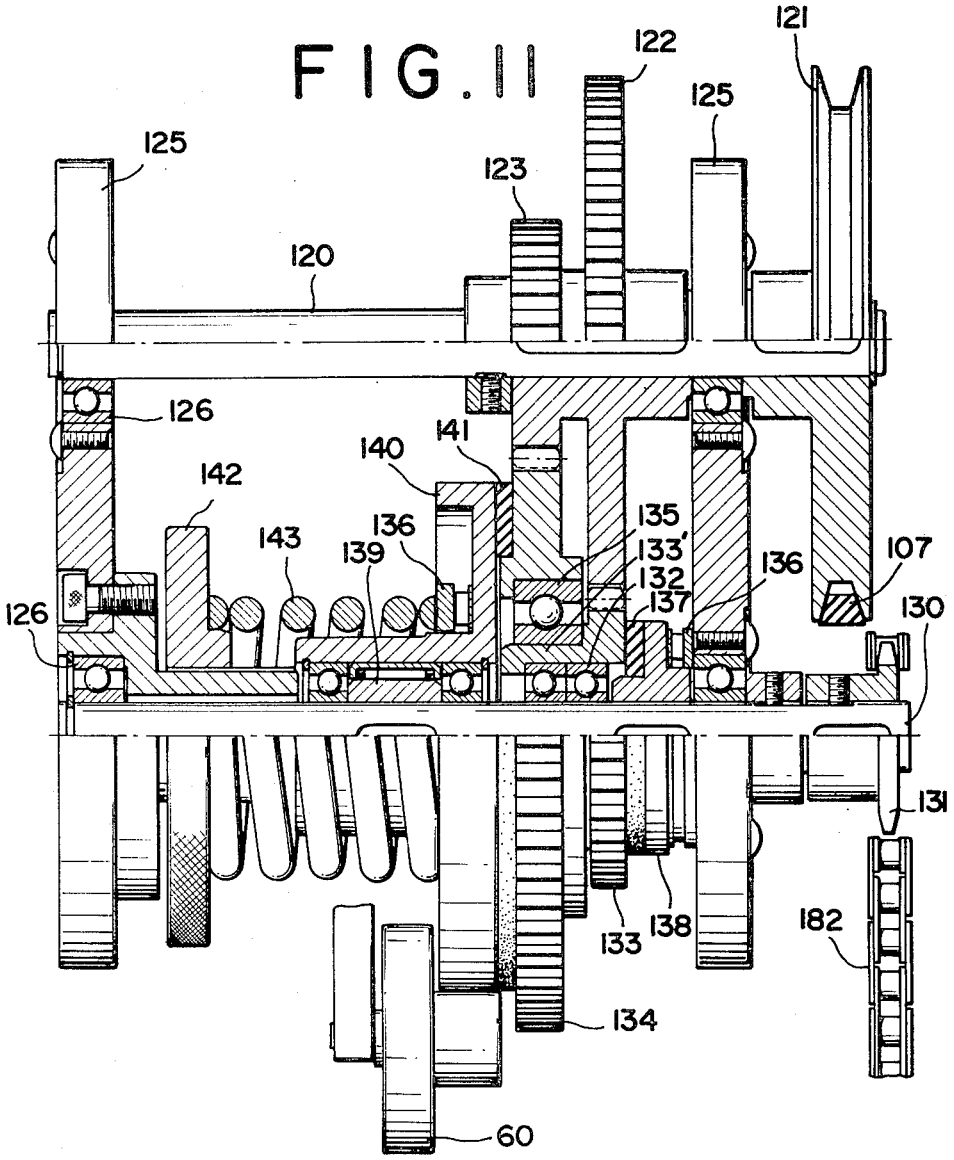

To describe the details of the band feeding, retracting and tightening mechanism (110), as shown in FIG. 11 the pulley of said motor is connected to a pulley (121) at the end of an input shaft (120) through a V-belt (107), and a gear (122) of larger diameter and a gear (123) of smaller diameter are secured to said input shaft (120) by keys or the like. On the other hand, on an output shaft (130) disposed in parallel with said input shaft (120) there is provided a sprocket (131) at its end, and through a bearing (132) a gear (133) of smaller diameter meshes with the gear (122) of larger diameter on said input shaft (120). Further, adjacent to said gear (133) of smaller diameter there is provided a gear (134) of larger diameter, which meshes with the gear (123) of smaller diameter of said input shaft. Said gear (134) of larger diameter is provided at the surface of its inside diameter with a bearing (135) and it is axially supported on a projection (133') of the gear (133) of smaller diameter. The gear (133) is supported by a clutch plate (137) of a clutch wheel (138) being keyed to the input shaft (130) through a thrust bearing (133) which abuts against the side face of a stool (125). Furthermore, the gear (134) of larger diameter abuts against a clutch plate (141) fixed to a clutch wheel (140), said wheel internally storing a one-way clutch mechanism (139) cooperating with the output shaft (130), and by a spring (143) whose one end abuts an adjusting screw (142). The clutch plate (141) is pressed to the side face of said gear (134) of larger diameter thereby to tightly hold the gears (133), (134). Numeral (126) designates a bearing which is fitted between the stool (125) and both the shafts (120), (130).

Figure 12:
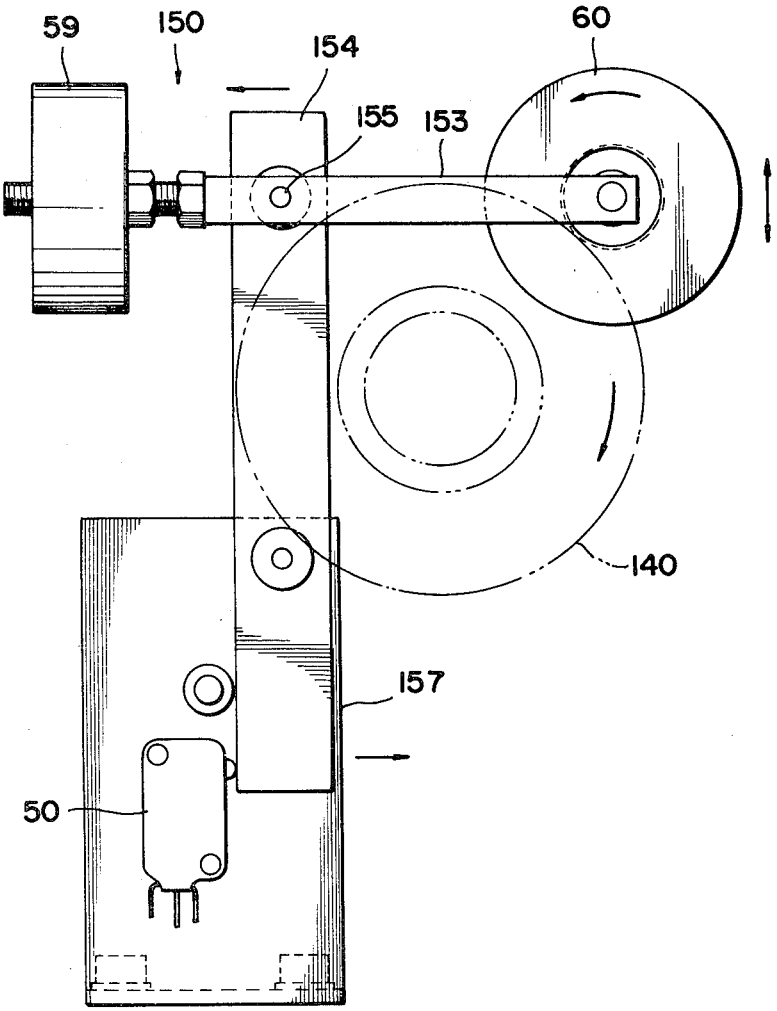

Reference numeral (60) is a fly-wheel of means (150) for detecting the completion of a secondary tightening. That is, as shown in FIG. 12, a rotatable fly-wheel (60) is provided in sliding contact with the outer peripheral flange of a clutch wheel (140). Said fly-wheel (60) is supported by a bearing at the end of a bearing member (153) having a weight (59) at its rear end, while the middle portion of said bearing member (153) is supported (155) by bearing at the upper end of a support member (154). It is constructed in such a way that the lower end of the support member (154) may operate the limit switch (50), and the middle portion of the member supported by bearing to a support plate (157) so that the support member may be rotatably supported.

Figure 13:
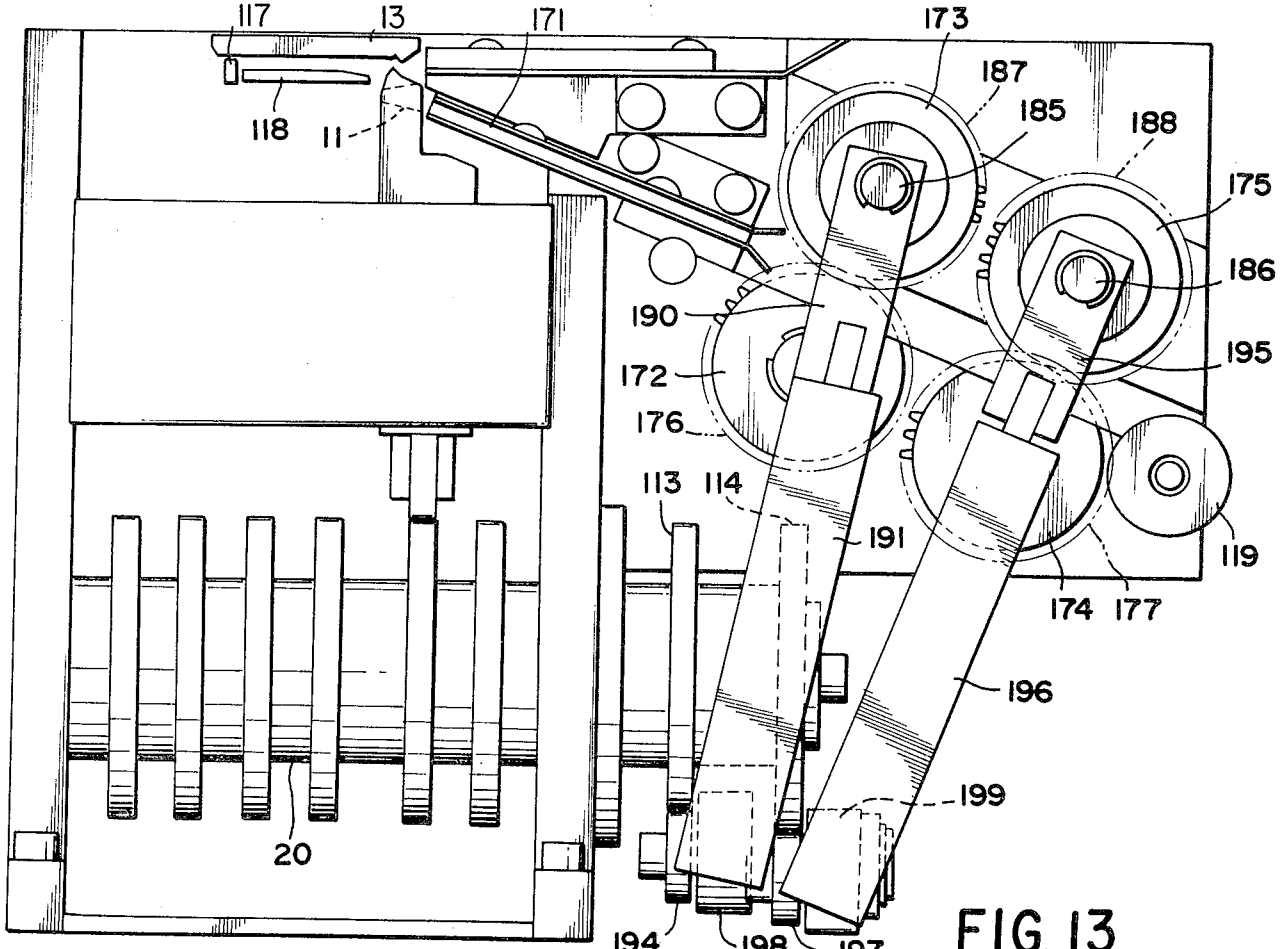
Figure 14:
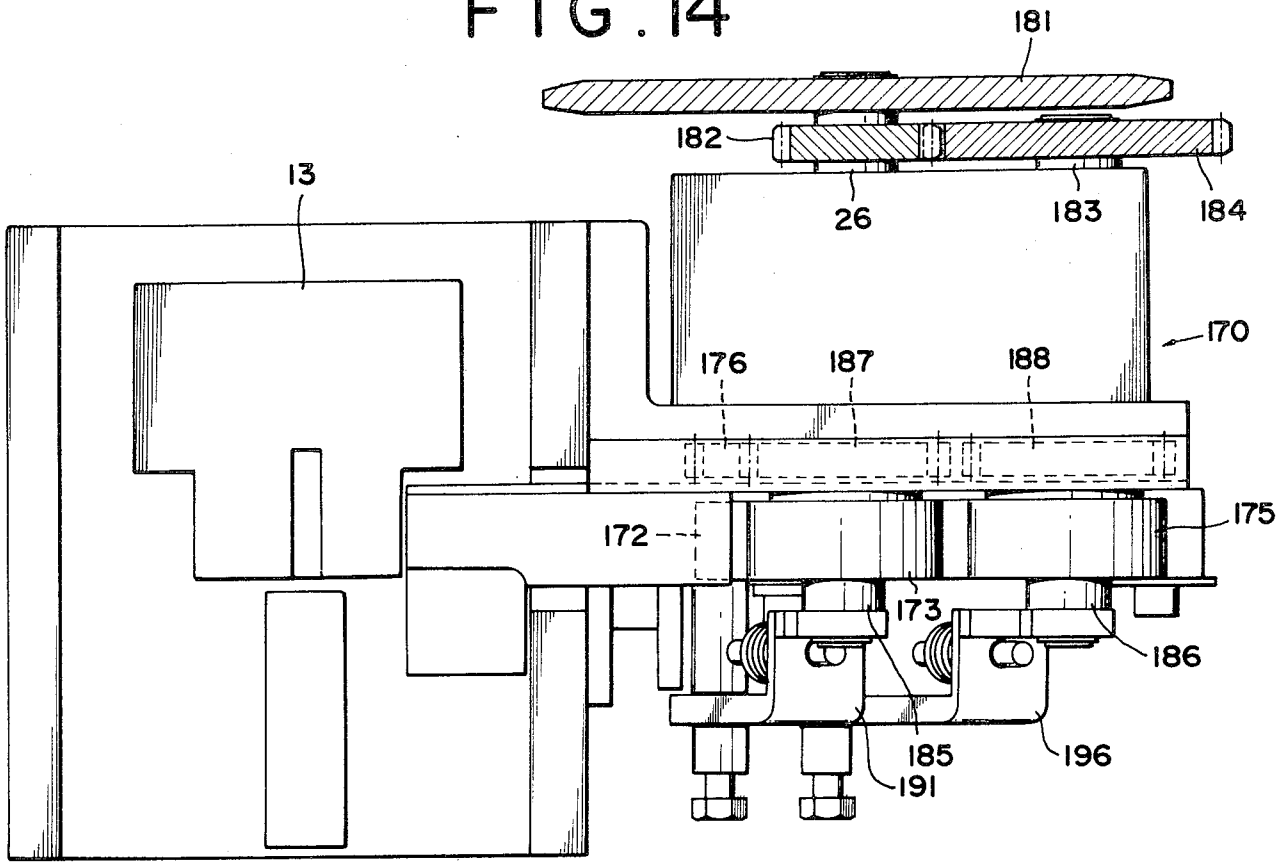
Figure 15:
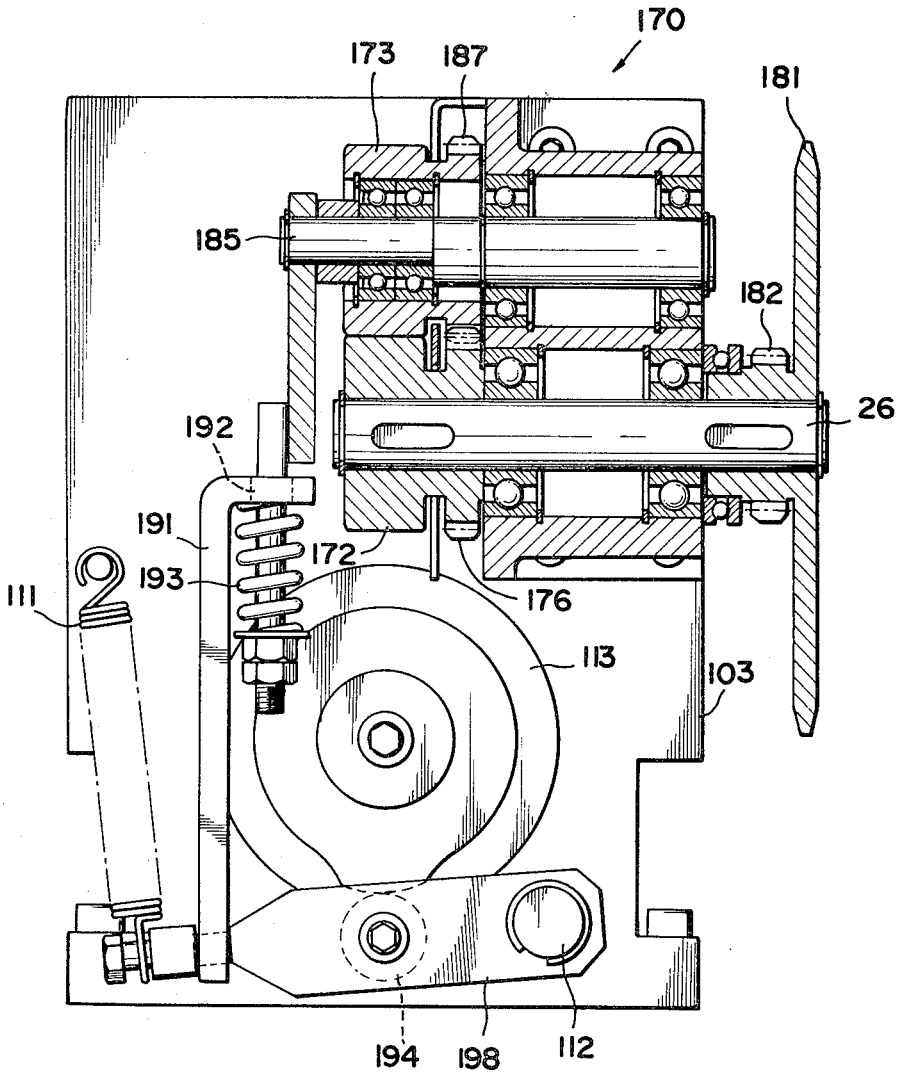

FIGS. 13 to 15 show a feed roller portion (170). Numeral (171) designates a band chute. A correct-rotating roller (172) and reaction roller (174) are arranged at a predetermined space in conjunction with said band chute. A sprocket (181) provided on a drive shaft (26) of the correct-rotating roller (172) is connected to a sprocket (131) of said output shaft (130) through a chain (182). Moreover, a gear (182) is provided at the sprocket (181) side of said drive shaft (26), and said gear (182) meshes with a gear (184) provided at the shaft (183) of said reaction roller (174) whereby the two rollers rotate in opposite directions. Because of obtaining high torque at low speed the gear (184) of the reaction roller is of larger diameter in the embodiment as shown in the drawings.

References (173) and (175) are respectively correct-rotating and reaction touch rollers, which are supported by bearings on eccentric shafts (185) and (186) respectively, and they are provided in one body with gears (187) and (188). These gears are meshed with other gears (176) and (177) provided in one body with respective rollers (172) and (174). That is, the gear (176) of said correct-rotating roller (172) is meshed with the gear (187) of said correct-rotating touch roller (173), whereas the gear (177) of said reaction roller is meshed with the gear (188) of said reaction touch roller (175), whereby a pair of correct-rotating and reaction rollers are constituted in two groups. Needless to state, therefore, each of the pairs of said gears (176) and (187), and said gears (177) and (188) are of the same diameter.

The upper ends of operating rods (190), (195) are pivotally mounted at the ends of the eccentric shafts (185), (186) of said correct-rotating and reaction touch rollers (173), (175), and the lower ends of the operating rods (190), (195) are idly inserted into holes (192) provided at the bent pieces of L-shaped interlocking rods (191), (196) and then connected to the interlocking rods through springs (193). The lower ends of said interlocking rods (191), (196) are mounted to the ends of arm rods (198), (199) having rollers (194), (197) respectively. One end of each of the arm rods (198), (199) is pivotally supported by bearing at a shaft (112) projected from the machine bed (102), while the other end of each thereof is anchored with a spring (111) so as to be biased towards a band chute (171).

Numerals (113), (114) are cams which are disposed on the shaft which is an extension of the cam shaft (20) actuating the heater (not shown), the right-hand press (11), the center press, etc. The cams abut against the the rollers (194), (197) of said arm rods (198), (199) thereby to be operated relative to the interlocking rods (191), (196) and therefore to the operating rods (190), (195). Said cam shaft (20) is driven by a reduction gear (106) interlocking with a motor (21). This motor can be coused with the motor interlocking with the pulley provided at the drive shaft of the correct-rotating rollers.

Additionally, if the bearings of said correct-rotating and reaction touch rollers (173), (175) are of self-aligning type, the rollers (173), (175) can be prevented from being pressed against the correct-rotating and reaction rollers (172), (174), while tilting when the operating rod (190) is lowered.

In the drawings the reference (13) indicates a slide table, the reference (117) a limit switch, the numeral (118) a band guide and the numeral (119) a guide roller respectively.

In FIGS. 10 to 15, the motor (21) is turning always in a constant direction. This turning is transmitted to the input pulley (121) through the V-belt (107) when the input shaft (120) always rotates. As a result, the gear (122) of larger diameter and the gear (123) of smaller diameter on the input shaft (120) are to rotate all the time. Further, the gears (133), (134) of larger and smaller diameters on the output shaft (130), which mesh with said gears are also to rotate. Now that the gear (133) of smaller diameter on the output shaft (130) rotates quicker than the gear (134) of larger diameter, the one-way clutch will not operate so that the rotation of the gear (133) of smaller diameter is transmitted to the output shaft (130) through the clutch plate (137) and the clutch wheels (138), (140), and then the rotation of the output shaft (130) is transmitted to the sprocket (181) at the feed roller portion (170). The sprocket (181) is connected to the sprocket (131) at the end of said output shaft (130) through a chain (182).

Accordingly, the gear (182) on the shaft (180) of the correct-rotating roller (172), the roller (172) and the gear (176) in one body with said roller are rotating counterclockwise in FIG. 13.

As a result, the reaction roller (174) turns clockwise in FIG. 13 by the gear (184) meshing with said gear (182). The correct-rotating and reaction touch rollers (173), (175) are also turning always in their active directions by touch roller gears (187), (188) slightly meshing with the gears (176), (177) of said correct-rotating and reaction rollers (172), (174).

However, between the correct-rotating roller (172) and the correct-rotating touch roller (173) there is a clearance exceeding the thickness of at least one band because the convex portion of the cam (113) is not positioned to push the roller (194) up, so as not to affect the band within the band chute (171).

By the actuation of a starting switch (not shown) or the actuation that the band end presses the limit switch (117) provided at the end of the band guide (118) or by the signal of a timer, the clutch (108) is actuated to rotate the cam shaft (20) and to raise the right-hand press (11) thereby holding the end of the band. Since the cam (114) is also turning, the operating rod (195) is pushed down through the roller (197), the arm rod (199) and the interlocking rod (196), when the eccentric shaft (196) revolves in the form of arc. The reaction touch roller (175) supported by a bearing at said eccentric shaft is pushed down, allowing itself to be pressed against the reaction roller (174). At this time the gear (177) completely meshes with the gear (188). Accordingly, the fed end of the band within the band chute (171) will be retracted at high speed by a pair of driving rollers.

A pair of said rollers (174), (175) further tighten the band while trying to strap the package, but since the torque exerted upon the band wound around the package reaches the sprocket (131) at the end of said output shaft (130) through the sprocket (181) and the chain (182) the output shaft slows down in rotation. That is, the gear (133) of smaller diameter on the output shaft (130) is intending to turn at high speed, but the speed is lowered owing to the primary tightening torque. Further, the lowered turning speed of the gear of smaller diameter results in the same turning speed as the gear (134) of larger diameter. When by the actuation of the one-way clutch (139) the rotation of the gear (134) of larger diameter is transmitted to said output shaft, the rotation reaches the feed roller portion (170) through the sprocket (131), and said pair of the reaction rollers (174), (175) rotate at low speed but with high torque thereby fastening the band stronger. If the band is fully tightened to the package, the detecting mechanism for the band tightening completion as shown in FIG. 12 will be actuated. That is, the tightening torque of the band is transmitted to the clutch wheel (140) on said output shaft (130) through the gear (182) on the shaft (180), said gearing meshing with the gear (184) of the reaction roller (174), the sprocket (181) and the chain (182). The output shaft (130) intends to stop with said tightening torque, and therefore the clutch plate (141) slides against the gear (134) of larger diameter. The fly-wheel (60) rotating on the clutch wheel (140) rolls toward the upper portion of FIG. 12 by inertia due to its decreased rotation so that the bearing member (153) rotates in the same direction. Accordingly, the support member (154) rotates to the left , and the lower end thereof releases the pressurization of the limit switch (50) at the contact point B. The clutch (108) of said reduction gear (106) changes to ON, and the cam shaft (20) rotates to grip the fed end of the band. By the rotation of said cam shaft (20) said inverting roller (174) and said reaction touch roller (175) are released from the close contact with the band to return to their normal positions, and finally each of the known processes of severing is completed. Since the cam shaft (115) turns the cam (113) the correct-rotating roller (172) and the correct-rotating touch roller (173) assume the states shown in FIG. 15. The band is brought into close contact between both the rollers, and a certain length of band is fed to the upper surface of the machine body. In this embodiment it is possible to determine the feeding length of band even by the length of the convex of said cam (113). If the band feeding finishes according to the rotation of said cam (113), a limit cam not shown, which interlocks with the cam shaft (20) operates allowing the clutch (108) to be OFF, said clutch transmitting the rotation of the motor (21) to said cam shaft through the reduction gear (6), and said cam shaft (115) ceases to rotate, when each of the mechanisms returns to its original position. To ensure accurate stoppage (and start) of the rotation an electromagnetic brake may be provided for the input of the reduction gear.

As described above in detail, a band cutting due to excessive tightening is prevented by the quick, reliable detection of the completion of band retracting and tightening in a strapping machine thanks to the simple mechanisms of the invention. The endurability of the drive mechanism for tightening is increased thereby to improve the performance of the entire strapping machine.

What is claimed is:

1. Apparatus for detecting the completion of a retracting and tightening process of a band in a strapping machine of the type which comprises means for feeding-out the band and for retracting the fed-out band including a drive roller; gripping means for gripping portions of the retracted band; and means for severing and fusing the fed end of the retracted band as it is gripped; drive means for driving said drive roller; and shut-off switch means which is actuated when said band has been fully retracted; the improvement wherein said drive means comprises:

a drive shaft operably connected to said drive roller;

a drive source;

a friction clutch mounted on said drive shaft for connecting said drive shaft with said drive source;

a fly wheel operably connected to said friction clutch to be rotated synchronously therewith, said fly wheel being arranged to continue to rotate under its own inertia after rotation of said friction clutch ceases upon retraction of said band;

a bearing member connected to said flywheel and enabling the axis of said flywheel to travel in response to continued rotation thereof, said bearing member being movable along with said axis of said fly wheel; and a support member operably connected to said bearing member for movement therewith relative to said switch means to actuate the latter when rotation of said friction clutch ceases.

2. Apparatus according to claim 1, wherein said drive roller is mounted on said drive shaft.

3. Apparatus according to claim 1, wherein said drive roller is mounted on a second shaft separate from said drive shaft, the latter being connected to said second shaft by a motion-transmitting connection.

4. Apparatus according to claim 1, wherein said flywheel is driven directly by said friction clutch.

5. Apparatus according to claim 1, wherein said friction clutch and fly wheel include intermeshing gear teeth.

6. Apparatus according to claim 1 including spring means for biasing said fly wheel into driven connection with said friction clutch.

7. Apparatus according to claim 1, wherein said support member comprises a circular wheel rotatably carried by said drive shaft.

8. Apparatus according to claim 7, wherein said bearing member comprises an idler wheel mounted on said drive shaft.

9. Apparatus according to claim 1, wherein said switch means comprises a limit switch.

10. Apparatus according to claim 1, wherein said support member includes a rod which is engageable with said switch means.

11. Apparatus according to claim 1, wherein said support member carries a counterweight arranged to counteract the weight of said flywheel.

* * * * *